US006772728B2

(12) United States Patent
Al-hawaj

(10) Patent No.: US 6,772,728 B2
(45) Date of Patent: Aug. 10, 2004

(54) SUPERCHARGED RADIAL VANE ROTARY DEVICE

(76) Inventor: Osama Al-hawaj, P.O. Box 15462, Daiyah (KW), 35455

( * ) Notice: Subject to any disclaimer, the term of this patent is extended or adjusted under 35 U.S.C. 154(b) by 0 days.

(21) Appl. No.: 10/619,194

(22) Filed: Jul. 14, 2003

(65) Prior Publication Data

US 2004/0011321 A1 Jan. 22, 2004

Related U.S. Application Data

(63) Continuation-in-part of application No. 10/192,176, filed on Jul. 10, 2002, now Pat. No. 6,684,847.

(51) Int. Cl.[7] ..... F02B 53/04; F01C 1/00

(52) U.S. Cl. ..... 123/236; 123/237; 123/243; 418/261; 418/364

(58) Field of Search ..... 123/236, 237, 123/243; 418/101, 261, 364

(56) References Cited

U.S. PATENT DOCUMENTS

| | | | | | |
|---|---|---|---|---|---|
| 2,114,674 | A | * | 4/1938 | Buckbee | 123/236 |
| 3,301,233 | A | | 1/1967 | Dotto et al. | 123/243 |
| 3,589,841 | A | | 6/1971 | De Lisse | |
| 3,769,944 | A | | 11/1973 | Raymond | |
| 3,780,709 | A | * | 12/1973 | Williams | 123/237 |
| 3,904,327 | A | * | 9/1975 | Edwards et al. | 418/264 |
| 4,018,191 | A | | 4/1977 | Lloyd | 123/243 |
| 4,028,028 | A | | 6/1977 | Fuchs | |
| 4,097,205 | A | * | 6/1978 | Miles | 123/243 |
| 4,353,337 | A | | 10/1982 | Rosaen | 123/243 |
| 4,355,965 | A | | 10/1982 | Lowther | |
| 4,454,844 | A | * | 6/1984 | Kinsey | 123/236 |
| 5,415,141 | A | | 5/1995 | McCann | 123/243 |
| 5,509,793 | A | | 4/1996 | Cherry et al. | |
| 5,634,783 | A | * | 6/1997 | Beal | 418/264 |
| 6,030,195 | A | | 2/2000 | Pingston | |
| 6,536,403 | B1 | | 3/2003 | Elsherbini | |

FOREIGN PATENT DOCUMENTS

| | | |
|---|---|---|
| FR | 2578585 A1 | 9/1986 |
| JP | 06307252 A | 11/1994 |

* cited by examiner

*Primary Examiner*—Thomas Denion
*Assistant Examiner*—Thai-Ba Trieu
(74) *Attorney, Agent, or Firm*—David Kiewit

(57) ABSTRACT

A family of sliding vane rotary power devices provides two and four-phase internal combustion engines, as well as serving as pumps and compressors. All of these devices have an improved donut shaped rotor assembly having an integrated axial pump portion, an end shaft, a plurality of radial-directed passages and an equal plurality of sliding vanes in respective slots that are medially guided by cam followers moving in a pair of cam grooves The devices include an axial pump portion that acts as a supercharger for the four-phase internal combustion engine, a scavenger for the two-phase internal combustion engine, and as an axial pressure inducer when operating as a pump or compressor.

23 Claims, 18 Drawing Sheets

SUPERCHARGED RADIAL VANE ROTARY DEVICE

CROSS REFERENCE TO RELATED APPLICATIONS

This application is a continuation-in-part of the inventor's U.S. patent application Ser. No. 10/192,176 filed on Jul. 10, 2002, now issued as U.S. Pat. No. 6,684,847. The disclosure of U.S. Pat. No. 6,684,487 is incorporated herein by reference.

FIELD OF THE INVENTION

The invention relates to sliding vane rotary power devices, and more particularly to four-phase and two-phase internal combustion engines, pumps, compressors, fluid-driven motors, and expander devices where various ones of those devices differ from others by a simple modification or replacement of a back plate portion of a split housing

BACKGROUND OF THE INVENTION

This invention relates to a supercharged rotary power device of the radial sliding vane type. These types of devices are characterized in having a rotor assembly comprising a number of vanes equally spaced about the rotor and dividing the rotor chamber into discrete cavities. As the rotor turns, these vanes follow the wall contour of the rotor chamber and thereby provide cavities undergoing volume variation as the rotor rotates. The rotor chamber has an axis that can be concentric or eccentric with respect to the axis of the rotating member. This invention belongs to the former type in which the axis of the substantially oval-shaped chamber coincides with an axis of rotation and the chamber comprises two diametrically opposed quadrants of expanding cavities that are alternated by another two quadrants of contracting cavities. In a typical four-phase engine the processes of intake, compression, power and exhaust are distributed equally among the four quadrants. Additionally, the sliding vane device of the present invention can be configured to operate as a double-action pump or compressor, an expander device, or a two-cycle internal combustion engine primarily through the replacement of the back portion of the split housing and a rearrangement of exhaust ports.

Sliding vane rotary devices generally comprise straight vanes slidably received within respective slots radially formed in a rotor. As the rotor spins, vanes are driven outward by centrifugal forces to an extent constrained by the wall contour, so as to execute radially reciprocating motion as the rotor spins. In an effort to reduce vane tip loading and increase outward radial movement response, a variety of vane actuation methods have been developed. One class of devices employs a respective biasing spring disposed at the base of each vane. Another class uses a pair of controlling sidewall cam grooves engaged by sub-shafts fixed to lower side portions of a vane. Still another class uses a transfer passage connecting a pressurized fluid to the base of the vanes. Although the functionality of such means of vane actuation have been proven, they are characterized in some respects with increased friction, fluid slip, leakage, and complexity. Examples of rotary devices of the above type can be found in United States patent such as U.S. Pat. No. 6,536,403 to Elsherbini, U.S. Pat. No. 6,030,195 to Pingston, U.S. Pat. No. 4,355,965 to Lowther, U.S. Pat. No. 5,415,141 to McCann, U.S. Pat. No. 4,353,337 to Rosaen, and U.S. Pat. No. 4,018,191 to Lloyd

SUMMARY OF THE INVENTION

The present invention provides a rotary power device that can be configured, among other things, to serve as supercharged two-phase or four-phase internal combustion engine, a motor-driven pump or a compressor, a fluid-driven motor or an expander device by a simple replacement of a back portion of a split housing. Preferred embodiments of the invention comprise a medially split housing forming front and back portions, which together define a toroidal or donut shaped chamber or cavity elongated along one transverse axis and having a central axis coincident with the rotational axis of the device. The back portion comprises a central cylindrical internally projecting portion having intake channels connected to lateral ports. The mating faces of the front and back portion of the split housing include mirror-image cam grooves spaced apart by a medial annular channel that is in communication with the chamber space. The grooves have contours similar in shape to the inner peripheral wall of the chamber. Enclosed within the elongated donut-shaped chamber is a donut-shaped block rotor fixedly secured to an end shaft and rotatably carried at a front portion of the split housing. The rotor comprises a centrally bored portion having an integrated supercharger comprising a directly-driven axial inlet fan portion; where the bored portion rotatably encloses the central cylindrical projecting stator portion. The rotor comprises a plurality of radially open-ended compartments inwardly communicating through inward openings with lateral ports in the central cylindrical projecting stator portion. The radial compartments are disposed alternatively with an equal plurality of radial slots. A plurality of vanes are disposed in respective slots, each having an outer tip ring portion slidably protruding into the medial annular channel and medially surrounding ball elements entrapped within the mirror-image cam grooves, and thereby causing reciprocating sliding movement of the vanes as the rotor rotates. As the rotor spins a cavity formed between two adjacent vanes intermittently communicates with the ports in the central internally projecting stator portion so as to perform intake, compression, and power and exhaust functions. Other embodiments include ports and passages in both the central projecting stator portion and the outer stator portion.

It is desirable to increase the power output of such engines while keeping the engine compact and easily serviceable. Supercharging offers one way in which this goal can be achieved. Engine driven superchargers are normally arranged as a separate unit external to the engine housing. This gives rise to problems in arranging the drive for the supercharger and mounting it in an appropriate location where it can efficiently serve the induction system without interfering with the serviceability of the engine In addition to embodiments serving as supercharged two-phase or four-phase internal combustion engines, the rotary device of the invention can function as a motor-driven pump or compressor with an integrated axial fan or as a pump acting as a pressure inducer. This is accomplished by replacing the back portion of the split housing with one having the appropriate port and channel configuration so that the effect of the axial induction fan is to increase the volumetric efficiency.

The present application improves over the inventor's U.S. Pat. No. 6,684,847 by providing a supercharging capability, which includes an integrated axial fan portion within the rotor assembly. Moreover, the improved engine includes a simplified disposition of ports and a reduction of part count. The central protruding stator and back plate portions of the earlier machine become one unit, referred to as the back portion of the split housing, which has a centrally projecting stator portion.

One object of some embodiments of the invention is to provide a supercharged radial sliding vane power device having a simple, efficient and less costly means of vane actuation.

Another object of some embodiments of the invention is to provide an improved radial vane rotary power device that is light in weight, small in size, that has a simple disposition of intake and exhaust passageways and a reduced number of parts.

Yet another object of some embodiments of the invention is to provide a rotary power device that can be easily converted to another type of rotary power device, such as a supercharged four-phase or two-phase internal combustion engine, a pump, a compressor, an expander, or a fluid-driven motor or expander device, by a simple modification or replacement of a back portion of a transverse split housing.

Another object of some embodiments of the invention is to provide a four-phase or two-phase rotary internal combustion engine with integral supercharging capability.

Yet an additional object of some embodiments of the invention is to provide a positive displacement rotary pump or compressor with an integrated axial fan/pump inducer.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
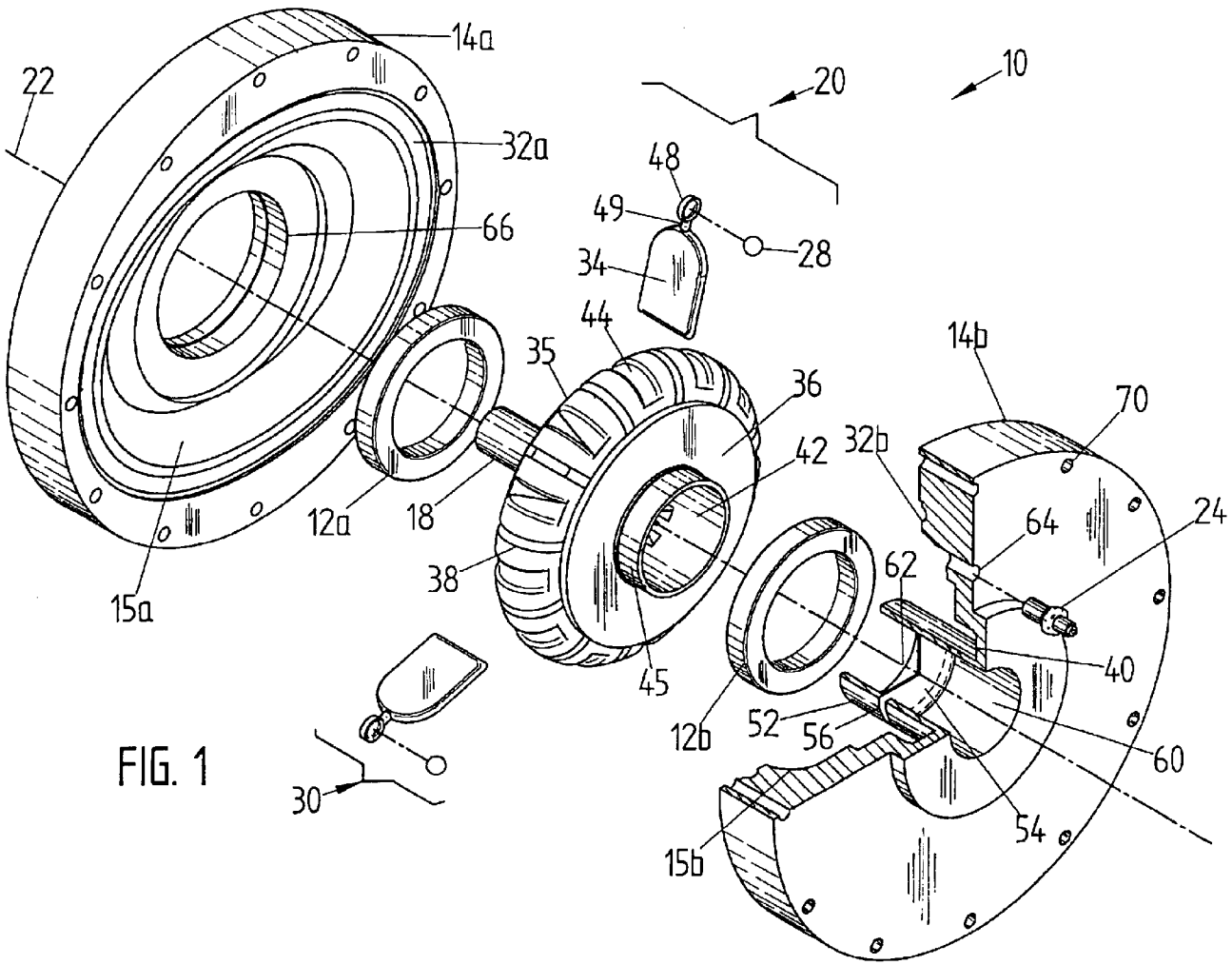
FIG. 1 is an exploded isometric view of a rotary power device of the invention with a portion of the housing cut away for purposes of illustration.

In studying this Detailed Description, the reader may be aided by noting definitions of certain words and phrases used throughout this patent document. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; the phrases "two-phase" and "four-phase" may be user interchangeably with "two-cycle" and "four-cycle", respectively.

Referring to FIG. 1 through FIG. 5*b*, the present rotary power device 10, when configured to operate as a four-phase internal combustion engine, comprises a medially split housing forming a front portion 14*a* and a back portion 14*b* having a central inwardly projecting portion 52. Taken together, these define a donut-shaped chamber having peripheral walls 15*a* and 15*b*. This chamber is elongated along one medial transverse axis so that the peripheral contour in the medial transverse plane has a substantially elliptical shape. Each mating surface of the front and back portion comprises a respective cam groove 32*a*, 34*b*. Mating the two surfaces defines a cam track comprising the two grooves 32*a*, 2*b* and an annular channel 33 communicating with the chamber. The front portion 14*a* of the split housing includes a central opening 66 for rotatably carrying the rotor shaft 18 and hub portion 19 in a suitable bearing 12*a*. The back portion 14*b* includes the central inwardly projecting cylindrical stator portion 52. The two portions of the split housing are fixedly coupled together by suitable means which may comprise a set of aligning holes 70 and tie rods (not shown). The back portion includes a side ignition port 64 for mounting an igniter 24 such as a spark plug or glow plug.

The central inwardly protruding stator portion 52 forms an integral portion of the back portion of the split housing and comprises a cylindrical tubular portion having a transverse wall 54, preferably disposed at a medial position, and defining a frontal intake channel 62 and an exhaust back channel 60. The front intake channel 62 comprises a peripheral intake port 58 and the back exhaust channel 60 comprises a peripheral exhaust port 56, where each port is defined over substantially a 90-degree angular extension.

Figure 2:
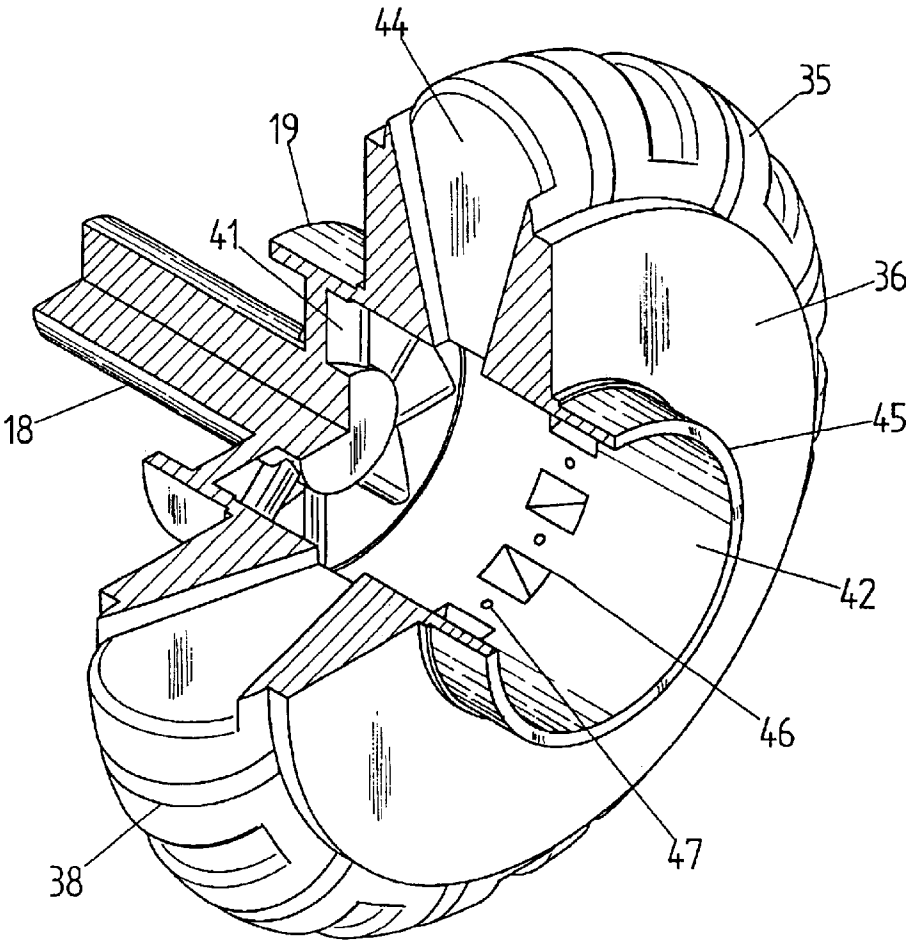
FIG. 2 is an isometric view of a rotor bock having a portion cut away for purposes of illustration.
Figure 3:
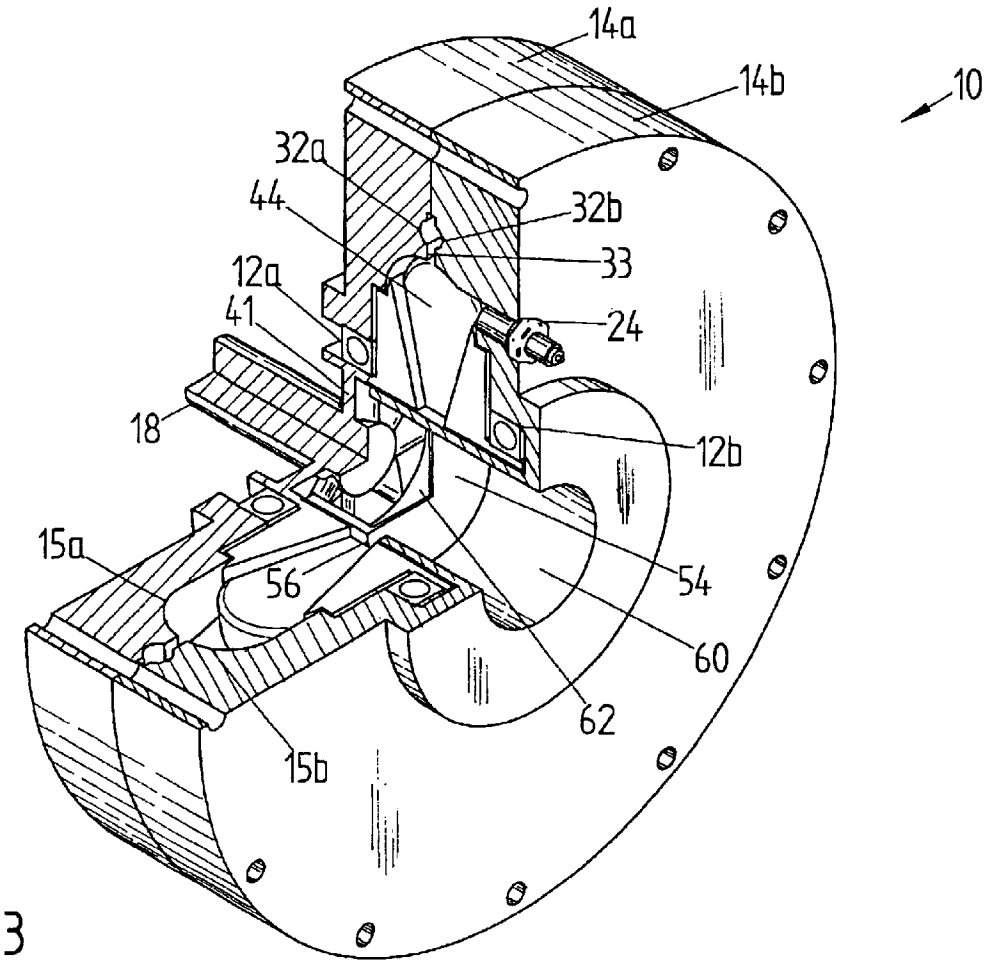
FIG. 3 is an isometric view of the rotary power device of FIG. 1, showing the rear face thereof, the device arranged to operate as a four-phase internal combustion engine, the view having a quarter potion cut away for purposes of illustration.
Figure 3A:
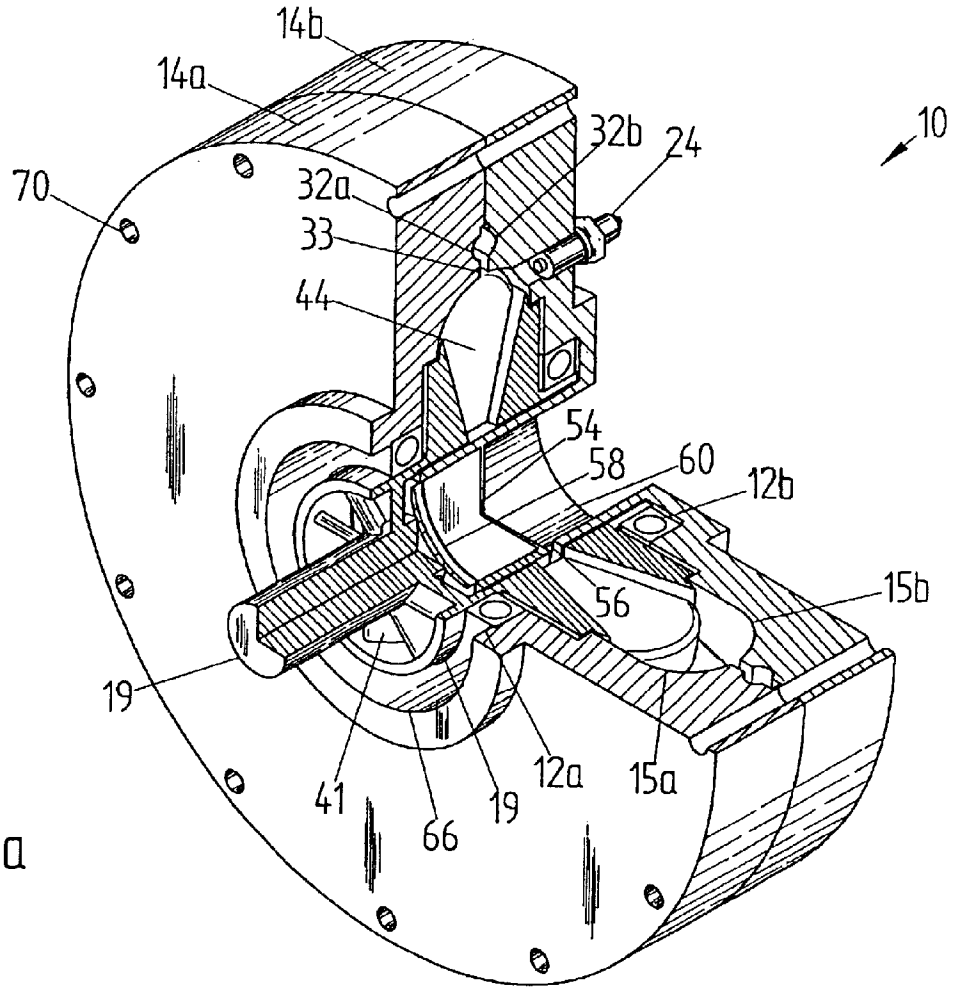
FIG. 3*a* is an isometric view of the rotary power device of FIG. 1 showing the front face thereof, the device arranged to operate as a four-phase internal combustion engine, the view having a quarter potion cut away for purposes of illustration.
Figure 4:
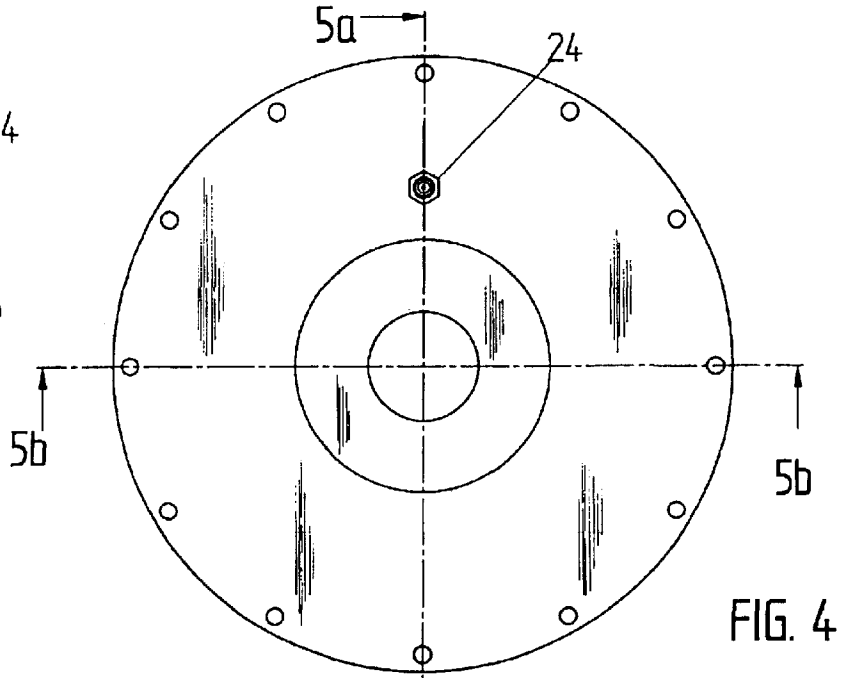
FIG. 4 is an end back view of the rotary power device of FIG. 1.
Figure 5B:
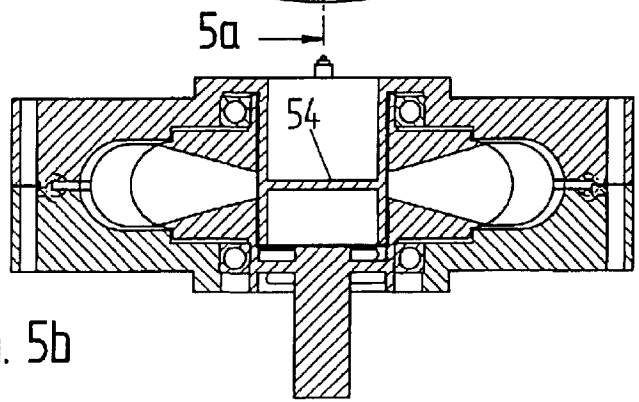
FIG. 5*b* is a cross-sectional view taken along line 5*b*—5*b* of FIG. 4.
Figure 5A:
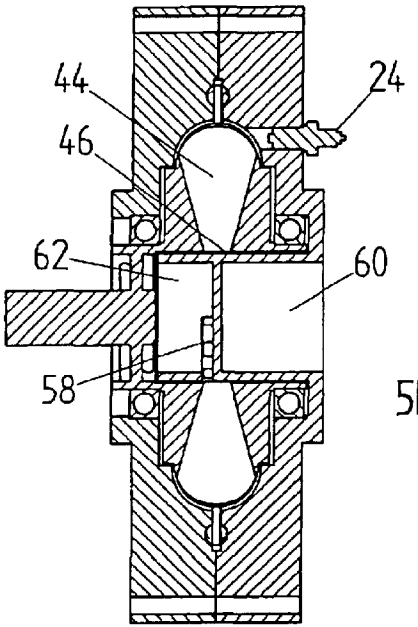
FIG. 5*a* is a cross-sectional view taken along line 5*a*—5*a* of FIG. 4.
Figures 6, 7A, 7B:
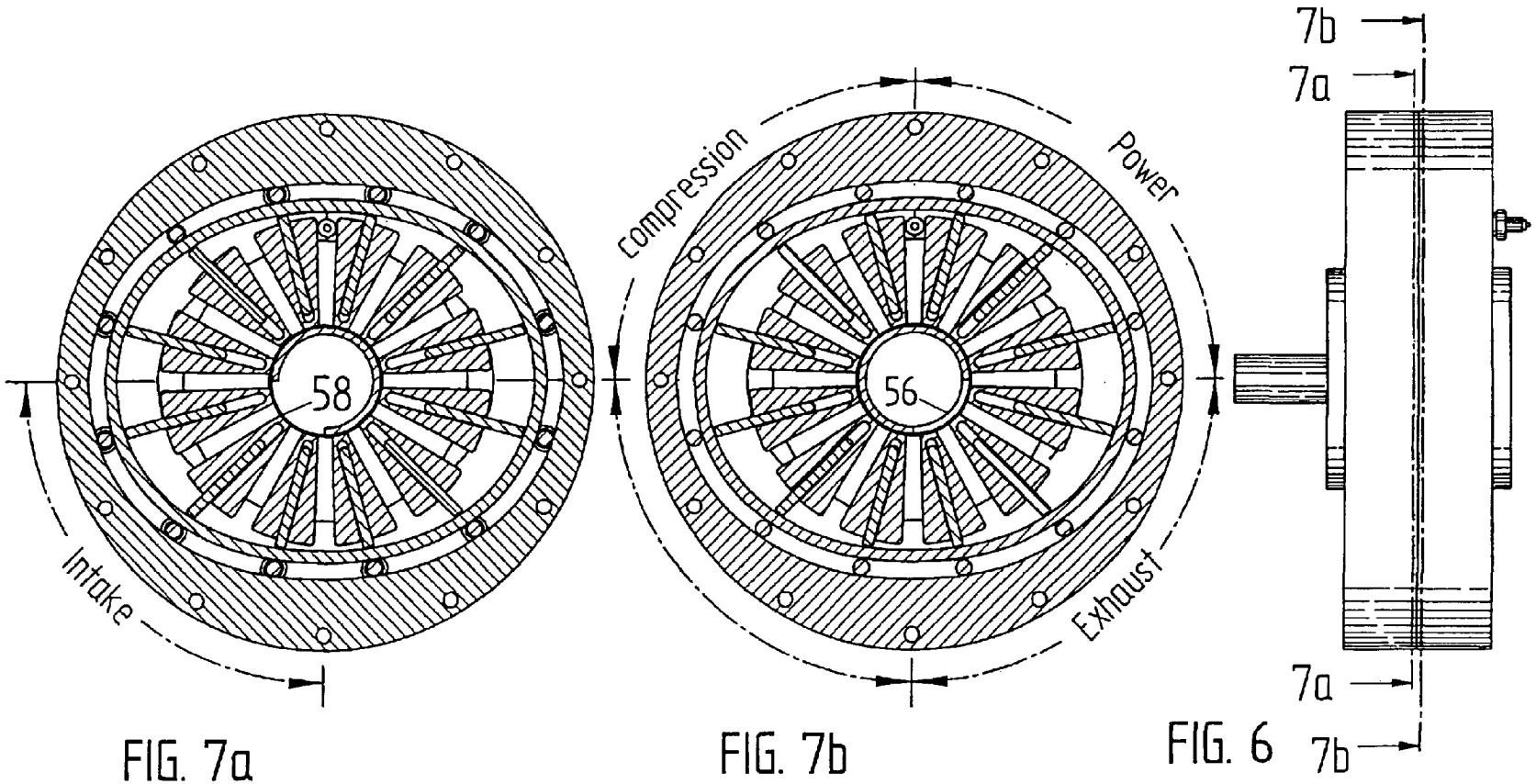
FIG. 6 is a side elevation view of the rotary power device of FIG. 1.
FIG. 7*a* is a cross-sectional view taken along line 7*a*—7*a* of FIG. 6.
FIG. 7*b* is a cross-sectional view taken along line 7*b*—7*b* of FIG. 6.

A rotor assembly 20 is concentrically mounted within the substantially elongated donut-shaped chamber defined by the outer walls 15*a*, 15*b* and by the inner wall of the central inwardly projecting cylindrical portion 52. A preferred rotor assembly comprises, as depicted in FIG. 2, a donut-shaped rotor block comprising a cylindrical portion 36 with a front hub portion 19, a back hub portion 45, a semi-circular peripheral wall portion 35 and a central end shaft 18 rotatable about a rotation axis 22. The donut-shaped block may further comprise a multiplicity of radial compartments 44 communicating with a central bore portion 42 through inner openings 46. There is also an equal multiplicity of radial slots 3 disposed in alternating relationship with the radial compartments, so that each radial slot is closed at both sides and communicates with the central bore by means of the openings 47. The rotor assembly is rotatably mounted within the medially split housing by means of front and back ball bearings. The front bearing 12*a* has an inner race mounted on the hub portion 19 and an outer race mounted on a recessed wall portion of the front stator portion. The back ball bearing 2*b* has an inner race mounted on the hub portion 45 and an outer race mounted on a recessed wall portion of the back stator portion, so that a small clearance is provided between the inner wall of the rotor central bore and the outer wall of the central inwardly projecting portion. The protruding shaft 18 and the central opening 66 of the front stator portion together define an annular inlet opening. The rotor assembly further includes an integrated axial fan portion 41 disposed at die front portion of the central bore, having blade bases coupled to the end shaft 18 and having outer tips coupled to the rotor hub portion 19 of the rotor block so that an external fluid, such as an air charge for an internal combustion engine, enters the device by passing between the fan blades.

A multiplicity of vane assemblies 30 is preferably disposed in the rotor radial slots. These are arranged so that each vane assembly includes a vane plate portion 34 having three straight sides and one outer semi-circular side, a ring portion 48 fixed to the outer middle tip of the semi-circular vane portion by means of an extended stub portion 49, and a cam follower element 28 comprising a ball freely enclosed by the ring portion 48. During assembly the cam followers are momentarily disposed in one cam groove portion, such as the front cam portion 32*a* of the front housing portion 14*a*, and then enclosed by attaching the mating back housing portion 14*b* that has a respective cam groove portion 32*b*. As the rotor spins, the vanes reciprocate outwardly and inwardly along respective radii, where the motion of the vanes is controlled and guided by the mating cam groove 32*a* and 32*b* engaging the cam followers 28 entrapped within the vane rim portions 48 and slidably moving within the annular channel 33. The ball elements in the cam may be manufactured from a self-lubricating material in order to eliminate the need for oil lubrication. Alternatively, oil lubrication may be made by injecting oil mixed with an intake charge or by direct injection of oil into the cam groove through external channels (not shown). Furthermore, the cooling of the present engine may be made by providing water jacket cooling passages within the front and back portions of the split housing (not shown).

An embodiment of the rotary power device 10 configured to function as a four-phase internal combustion engine, as shown in FIG. 5*a*, FIG. 5*b*, FIG. 6, FIG. 7*a* and FIG. 7*b*, comprises a frontal intake channel 62 and a back exhaust channel 60 physically separated by a medial wall 54. The intake channel 62 comprises a peripheral port 58 communicating with the radial compartments 44 through appropriate inner openings 46. Similarly, the exhaust channel 60 comprises a peripheral port 56 communicating with the radial compartments 44 through ocher openings 46. Each of the ports 58, 56 is disposed at a preselected position so as to be axially aligned with portions of the inner openings 46. An igniter 24 is provided through an ignition port 64 in the side wall of the back portion of the split housing.

To operate a four-phase internal combustion engine made in accordance with the depiction of FIG. 1 through FIG. 7*b*, a starter motor (not shown) is connected to the shaft 18 to initiate the rotation of the rotor 20 about the rotation axis 22 in order to start the engine. Each cavity, which is bounded by two adjacent extended vanes and the outer peripheral wall and which encloses a radial compartment 44, moves through four equally angularly displaced phases of: intake, in which the cavity volume increases; compression, in which the cavity volume decreases; power, in which the cavity volume again increases; and exhaust, in which the cavity volume again decreases. During the intake phase, a charge comprising an air/fuel mixture or pure air alone is allowed to flow through the front housing portion 14*a* through the annular portion of the central opening 66 surrounding the protruding shaft, and is induced by the axial fan portion 41 of the rotor to flow through the intake channel 62 and finally into the radial compartment 44 through a port 58 that is in communication with an inner opening 46. The effect of the axial fan portion is to induce and maintain an initially pressurized charge within the intake channel 62 at all times. This initial pressurization process, termed supercharging, is used to increase the mass flow rate during the intake phase and to thereby extract more power from the engine. During the compression phase, the trapped charge within the cavity and compartment increases in pressure as the vanes retract inwardly and as the cavity volume decreases. Near the end of the compression phase an injection of a fuel charge (not shown) is made in those cases in which the intake fluid comprises only air, and this is followed by ignition of the charge by a spark or glow igniter 24 disposed in the ignition port 64. During the power phase, the expanding combustion gases provide a net pressure force on the outwardly extending vanes, causing the rotation of the rotor. During both the compression and expansion phases the outer wall of the central inwardly projecting stator portion 52 blocks the compartment inner opening 46. During the exhaust phase, the vanes retract inwardly as the cavity volume decreases. At the beginning of the exhaust phase, a brief blow down of combustion products takes place followed by the exhaust process as the volume decreases while the inner opening 46 registers with the exhaust port 56 in communication with the exhaust channel 60.

Figure 8:
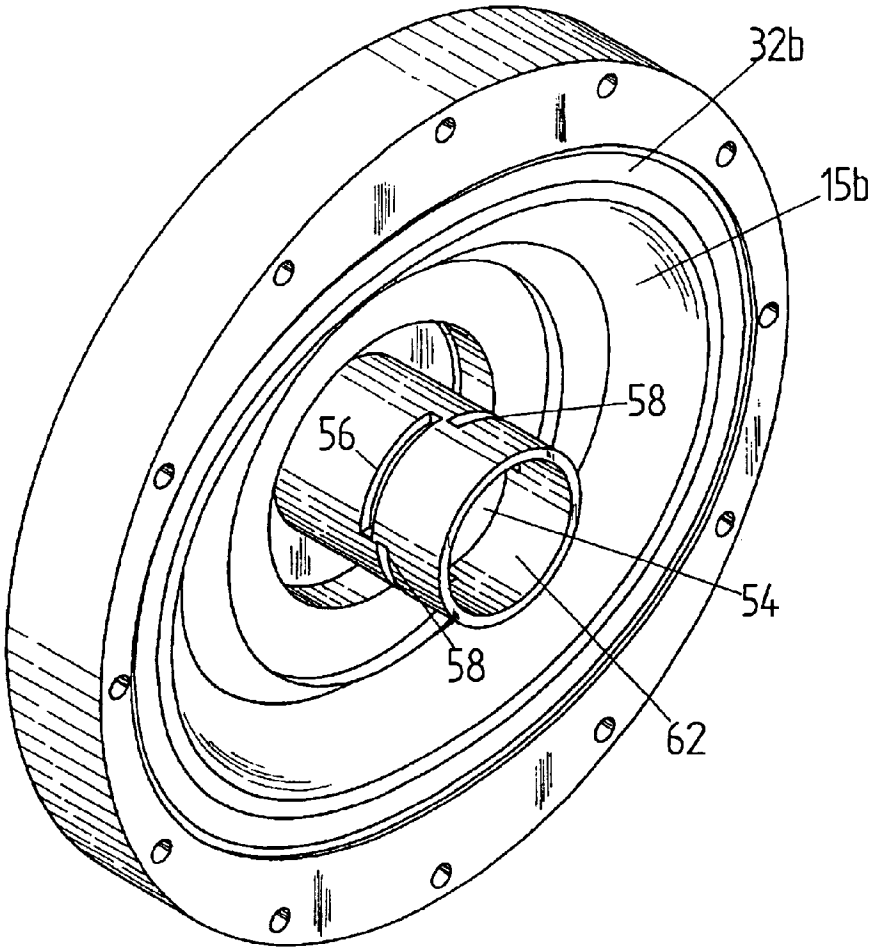
FIG. 8 is an isometric view of an alternate back portion of a housing of the rotary power device configured to operate as a pump, a compressor, a fluid-driven motor or an expander device.
Figure 9:
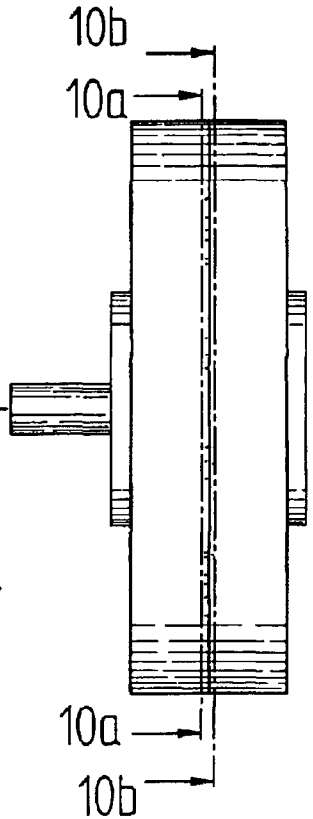
FIG. 9 is a side elevation view of a rotary power device using the alternate back portion shown in FIG. 8.
Figure 10B:
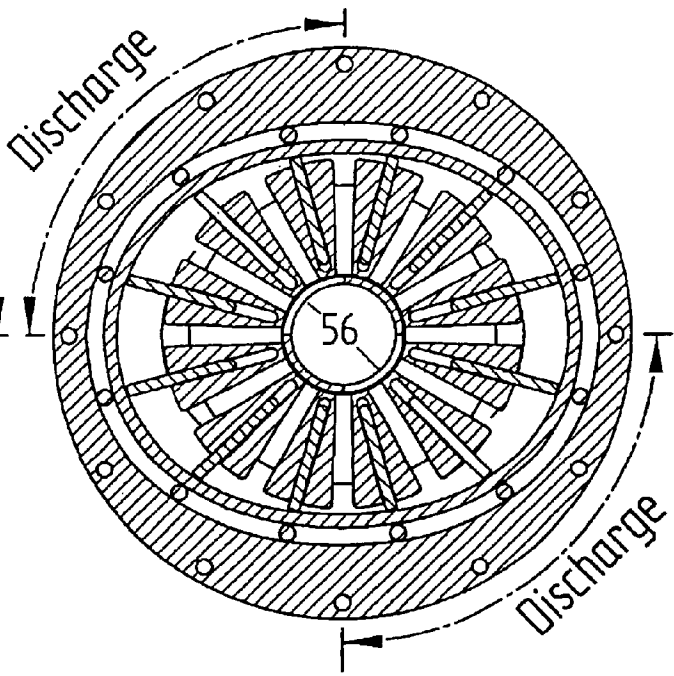
FIG. 10*b* is a cross-sectional view taken along line 10*b*—10*b* of FIG. 9.
Figure 10A:
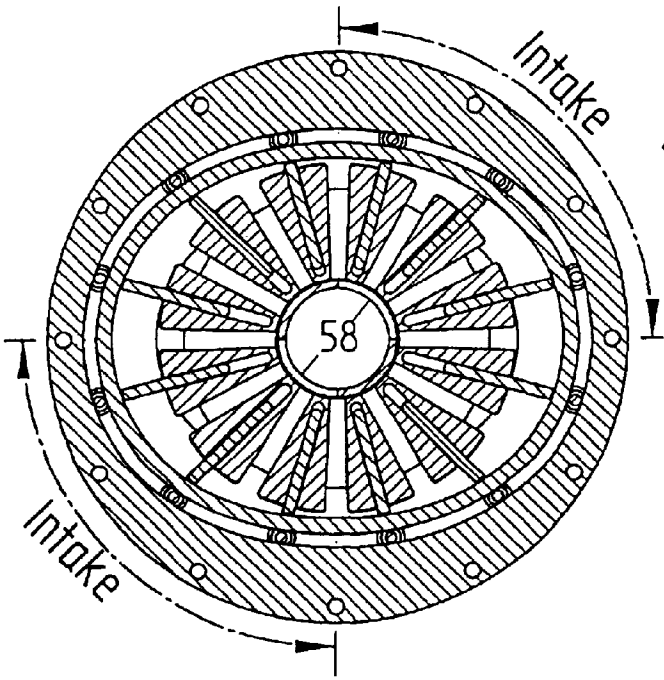
FIG. 10*a* is a cross-sectional view taken along line 10*a*—10*a* of FIG. 9.

Another embodiment of the rotary power device of FIG. 1 is a device capable of operating as one of a motor-driven pump or compressor devise, a fluid-driven motor, or an expander device. Replacing the back portion of the housing 14*b* with the one shown in FIG. 8 creates this embodiment. In this embodiment, the intake ports 58 comprise a diagonal pair communicating with the intake channel 62. The exhaust ports 56 comprise another diagonal pair communicating with the exhaust channel 60. As depicted in FIG. 9, FIG. 10*a* and FIG. 10*b*, a rotary device according to this embodiment comprises two opposed intake phases alternated by two opposed exhaust phases. During intake phases the rotor inner openings 46 are axially aligned with the intake ports 58 and during the discharge phases the inner openings 46 are aligned with the exhaust ports 56.

In functioning as a pump or compressor, the rotor is made to rotate by coupling the end shaft 18 to a driving means, such as a motor. A sealed cavity is enclosed between two vanes having outer vane tips making a small-clearance engagement with the toroidal wall and the side wall of the chamber. Each cavity is preferably bounded by two vanes and encloses a radial compartment that goes through two 90-degree angular displacements of expanding volume alternated by two 90-degree angular displacements of contracting volume. During the expanding volume phases fluid is sucked into the intake channel 62 through the front housing portion 14*a* and through the annular portion of the central opening 66 surrounding the protruding shaft. This is enhanced by the axial fan portion 41 as the inner opening 46 registers with intake ports 58 in communication with the frontal intake channel 62. During the contracting volume phases the fluid is pressurized and expelled as the inner openings 46 register with the ports 56 in communication with the exhaust channel 60. Thus, simultaneous processes of diagonal intake and diagonal exhaust take place as the rotor rotates.

In functioning as a fluid driven motor or expander device, a pressurized fluid is communicated through the annular portion of the central opening 66 surrounding the protruding shaft, and is then inducted by the axial fan portion 41 that leads to intake channels 62 in communication with intake ports 58. This provides a net pressure turning force on the outwardly extending vanes as the cavities expand, thus causing rotation of the rotor. At the same time, the resulting rotation causes the expulsion of the depressurized fluid through the exhaust ports 56 in communication with the exhaust channel 60 as the vanes retract inwardly and the cavities contract in volume.

Figure 11:
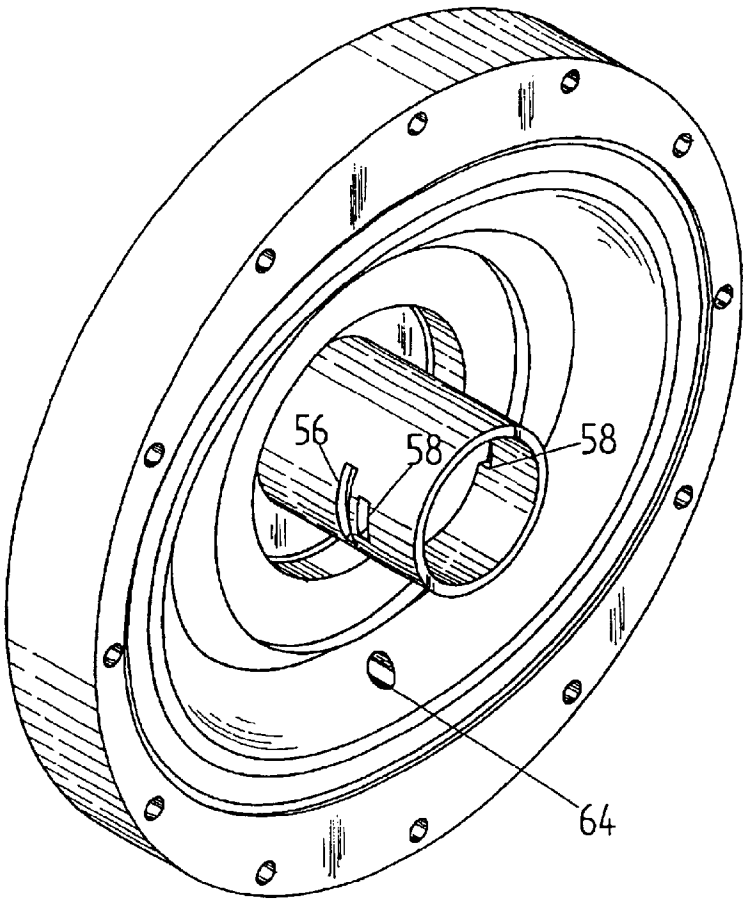
FIG. 11 is an isometric view of a second alternate back portion of the housing of a rotary power device configured to operate as a two-phase internal combustion engine.

Another embodiment of the rotary power device of FIG. 1 is one operating as a two-phase internal combustion engine in which the back housing portion 14*b* is replaced with one shown in FIG. 11. In thin embodiment the disposition of intake and exhaust ports in the internal protruding portion shown in FIG. 11. In this embodiment the angular extension of the intake port 58 is less than the angular extent of the exhaust port 56. Also, the intake port 58 is defined over overlapping angular extension with the exhaust port 56 in order to allow for air scavenging when the fresh charge displaces the spent charge. A diagonal pair of ignition port 64 may be used as injection ports adapted to receive injection means (not shown) for the initiation of the combustion process.

Figure 12:
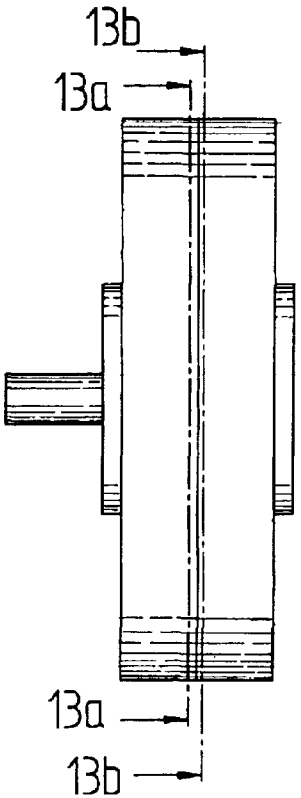
FIG. 12 is a side elevation view of a rotary power device using the alternate back portion shown in FIG. 11.
Figure 13B:
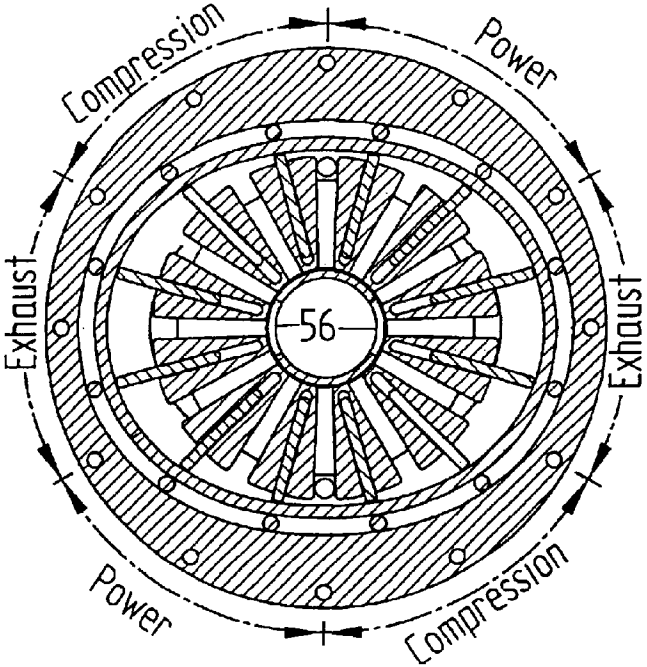
FIG. 13*b* is a cross-sectional view taken along line 13*b*—13*b* of FIG. 12.
Figure 13A:
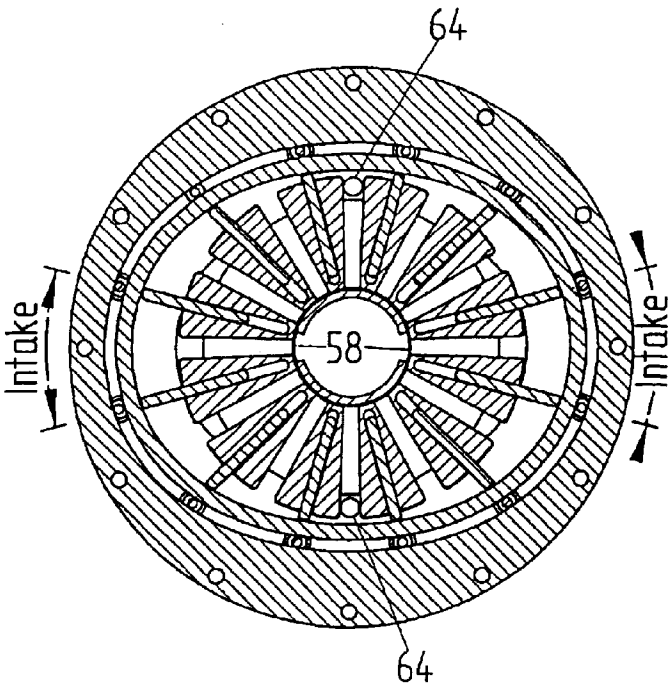
FIG. 13*a* is a cross-sectional view taken along line 13*a*—13*a* of FIG. 12.
Figure 14:
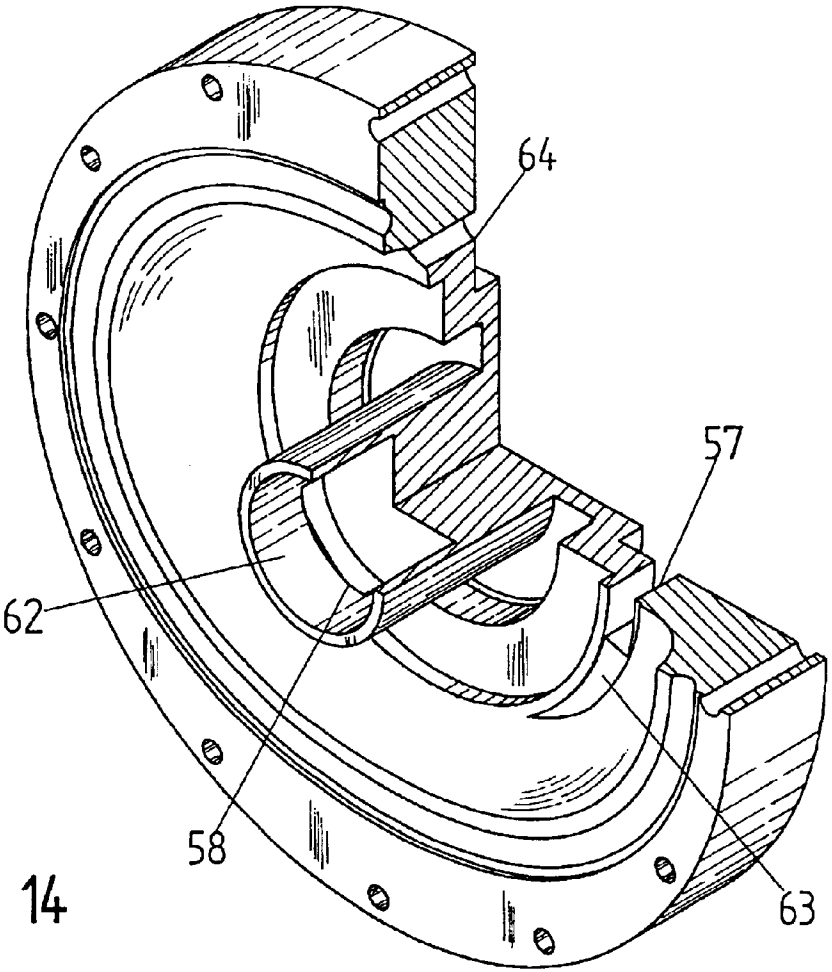
FIG. 14 is an isometric view of a third alternate back portion of a housing of a rotary power device configured to operate as a four-phase internal combustion engine.
Figure 15:
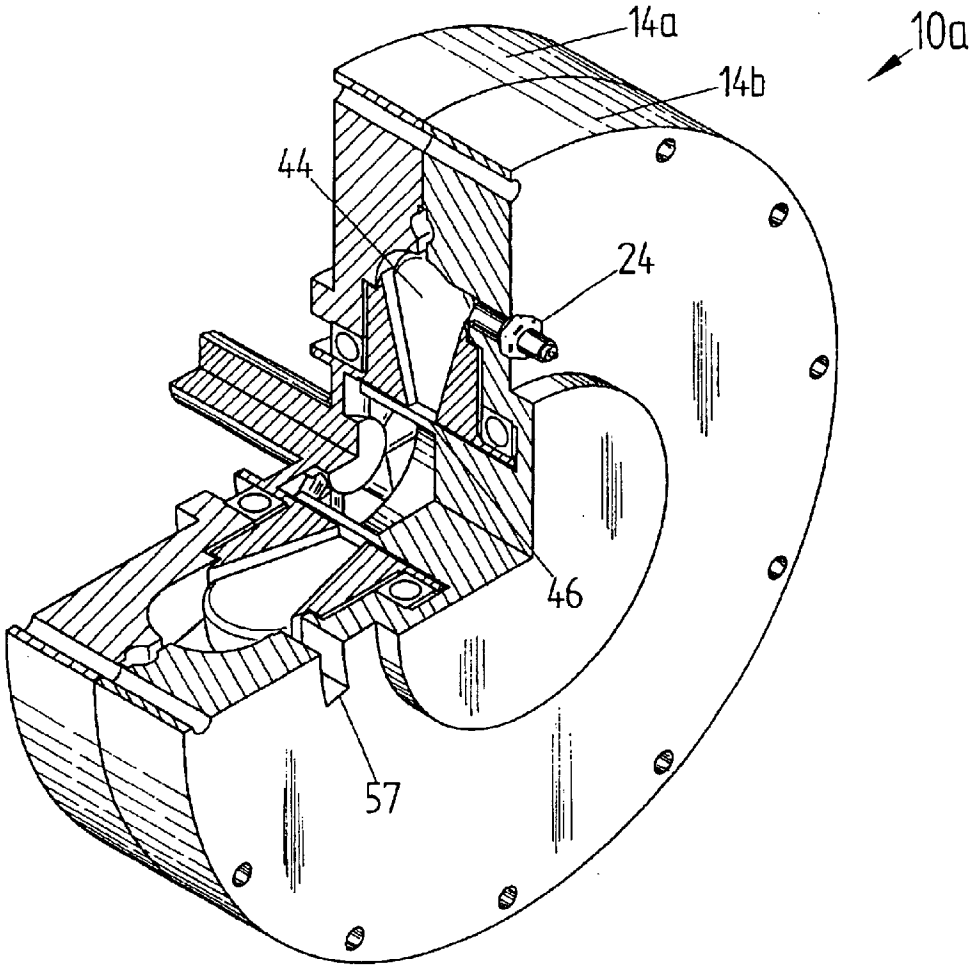
FIG. 15 is a partly cut away view of a rotary power device configured to operate as a four-phase internal combustion engine using the alternate back portion of FIG. 14.
Figure 16:
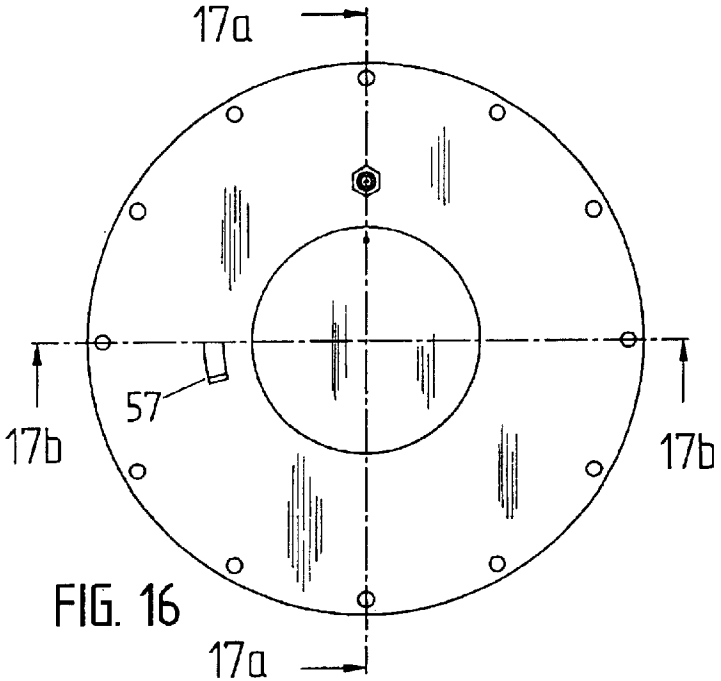
FIG. 16 is an end back view of the alternative rotary power device of FIG. 15.
Figure 17B:
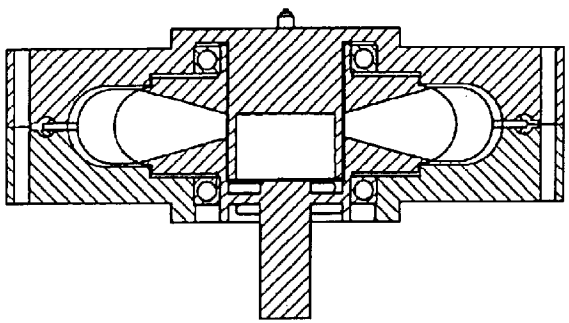
FIG. 17*b* is a cross-sectional view taken along line 17*b*—17*b* of FIG. 16.
Figure 17A:
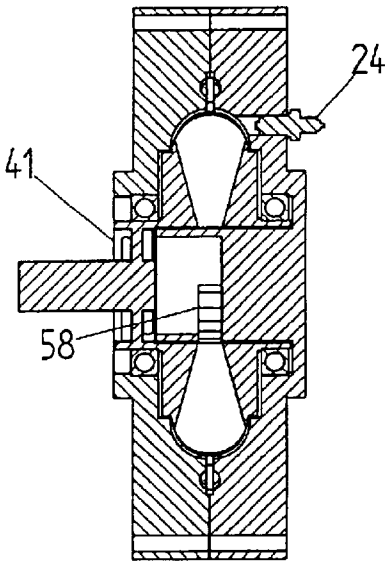
FIG. 17*a* is a cross-sectional view taken along line 17*a*—17*a* of FIG. 16.
Figure 18:
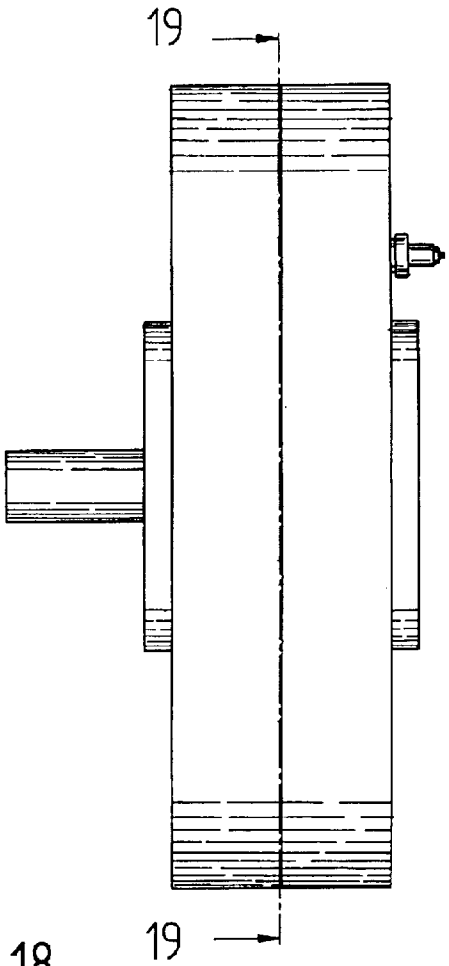
FIG. 18 is a side elevation view of the rotary power device of FIG. 15.
Figure 19:
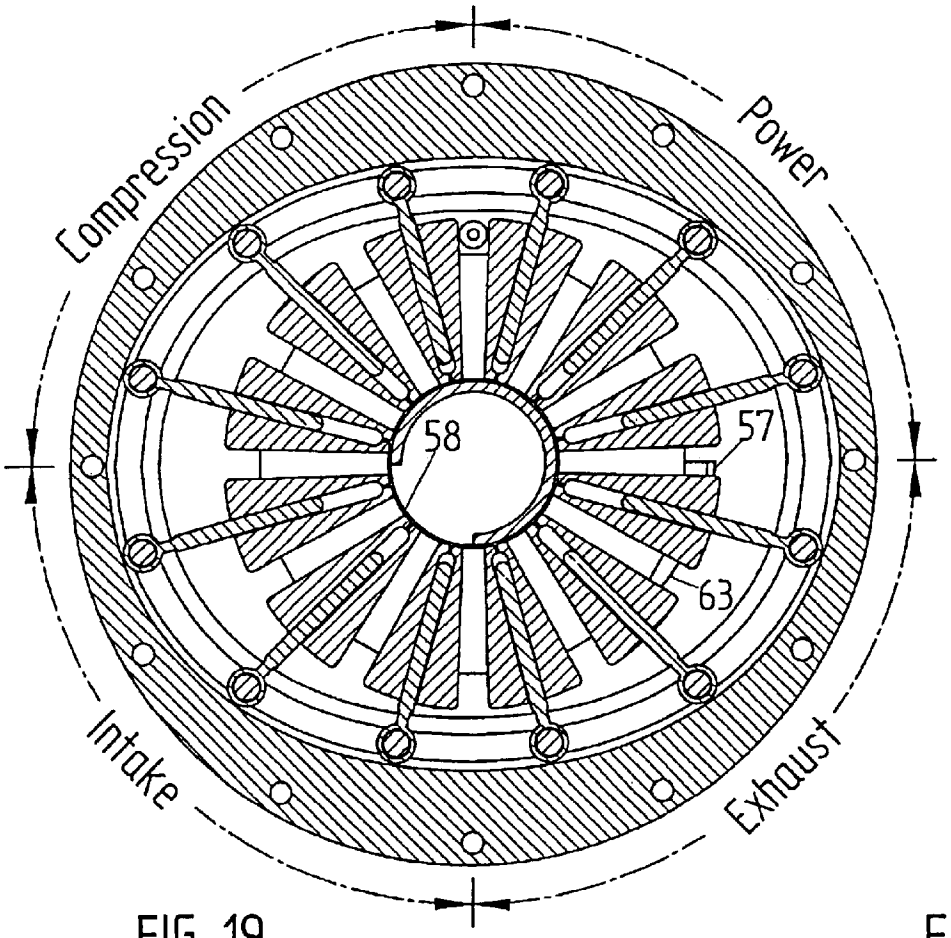
FIG. 19 is a cross-sectional view taken along line 19—19 of FIG. 18.

The operation of the two-cycle engine may be explained with reference to FIG. 12, FIG. 13*a* and FIG. 13*b* In this embodiment the rotor goes through three distinct and twice repeated phases comprising compression, power, and intake-exhaust phases (i.e. scavenging). Each set of three phases takes place within a half revolution of the rotor and each phase takes place simultaneously with a similar diagonally opposed phase of the other set. During the intake-exhaust phase the intake ports 58 overlap with a portion of the respective exhaust ports 56 to allow initially pressurized air in the intake channel 62 to flow thorough the inner opening 46, thus displacing the products of combustion within that compartment through inner openings 46 aligned with the exhaust port 56 in communication with the exhaust channel 60. During the compression phase the entrapped charge is compressed as the cavities contract toward their respective minima. In this phase the compartment inner openings 46 are blocked by the peripheral wall of the central inwardly projecting stator portion 52. Two diagonally opposed ignition or fuel injection means fire simultaneously to commence the power phase as sectors of opposing cavities expand. The power phase ends with an exhaust blow down phase as the cavities start registering with exhaust ports 56 over a small angular displacement. This is followed by a scavenging phase in which the newly admitted fresh air, initially pressurized by the axial fan portion 41, displaces the products of combustion.

FIG. 14 through FIG. 19 depict an alternate embodiment of the rotary power device 10*a* configured to operate as a four-phase internal combustion engine. In this embodiment the back portion of the split housing shown in FIG. 1 is replaced with one shown in FIG. 14, which includes only a fontal intake channel 62 having an intake peripheral port 58 in communication with an axially aligned radial compartment opening 44. Moreover, the plate portion comprises an exhaust channel 63 formed as a recess in the peripheral wall and connected to an exhaust port 57. The advantage of this alternate disposition of the exhaust port 57 in the plate portion of the back portion instead of in the central portion is to reduce possible short-circuiting leakage of the charge from the intake port 58 to the exhaust port 56 through the clearance between the central protruding portion of the outer wall and the inner wall of the rotor central bore. The operation as a four-phase engine for this embodiment is similar to the previous one except for the exhaust process, which takes place in the channel 63 leading to the exhaust port 57 in the plate portion of the split housing.

Figure 20:
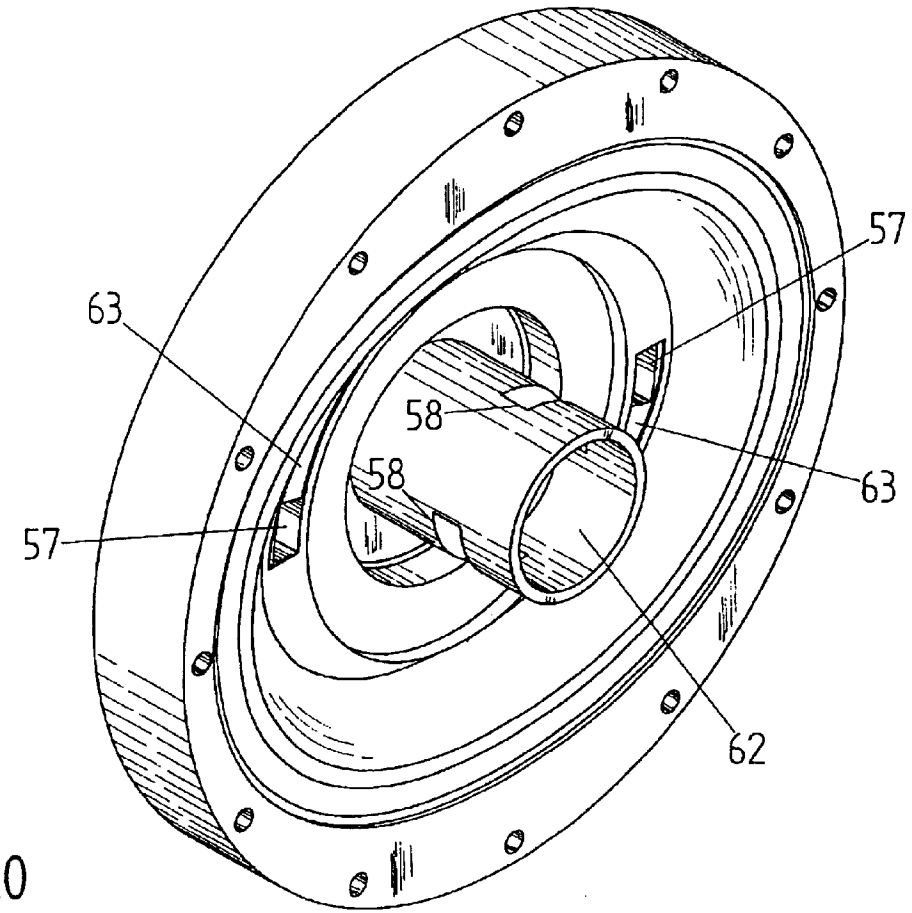
FIG. 20 is an isometric view of a fourth alternate back portion of a housing of a rotary power device configured to operate as one of a pump, a compressor, a fluid-driven motor or an expander device.
Figure 21:
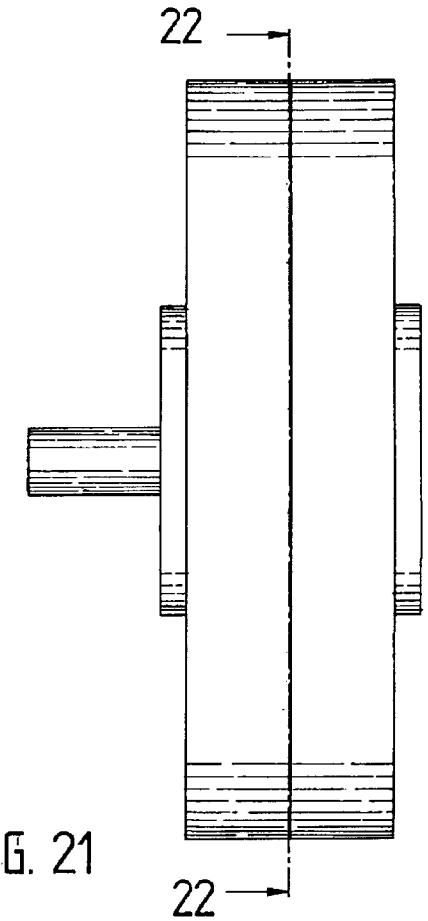
FIG. 21 is a side elevation view of the rotary power device of FIG. 20.
Figure 22:
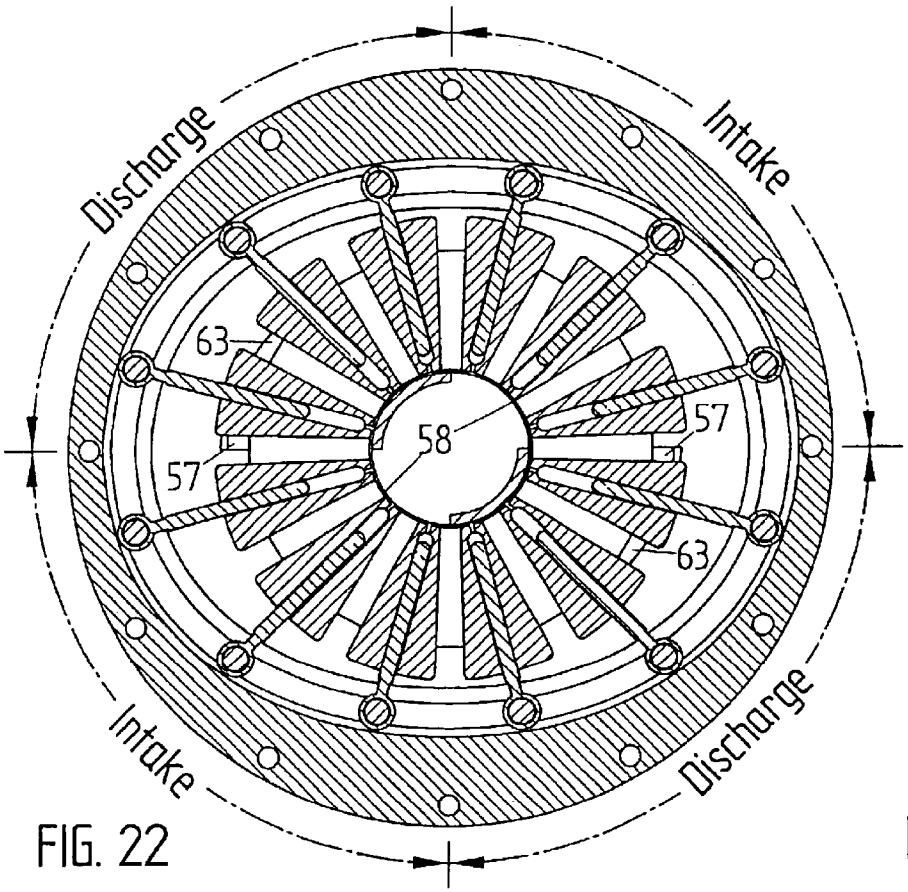
FIG. 22 is a cross-sectional view taken along line 22—22 of FIG. 21.

An alternate embodiment for a back portion for a rotary power device operating as a pump, a compressor, a fluid-driven motor or an expander device is shown in FIG. 20. This configuration also has the advantage of reducing possible internal short-circuiting leakage. In this embodiment the back portion of the split housing shown in FIG. 1 is replaced with the one shown in FIG. 20, in which the central protruding portion 52 comprises only a fontal intake channel 62 having diagonally opposed intake ports 58 in communication with an axially aligned rotor compartment opening 46, and the plate portion comprises a pair of diagonally opposed exhaust channels 63 formed recesses in the peripheral wall and connected to respective exhaust ports 57. The operation of the device as a pump is depicted in FIG. 21 and FIG. 22, in which the exhaust phase takes place in the diagonal pair of wall channels 63 leading to respective exhaust ports 57 in the plate portion of the back portion of the split housing.

Figure 23:
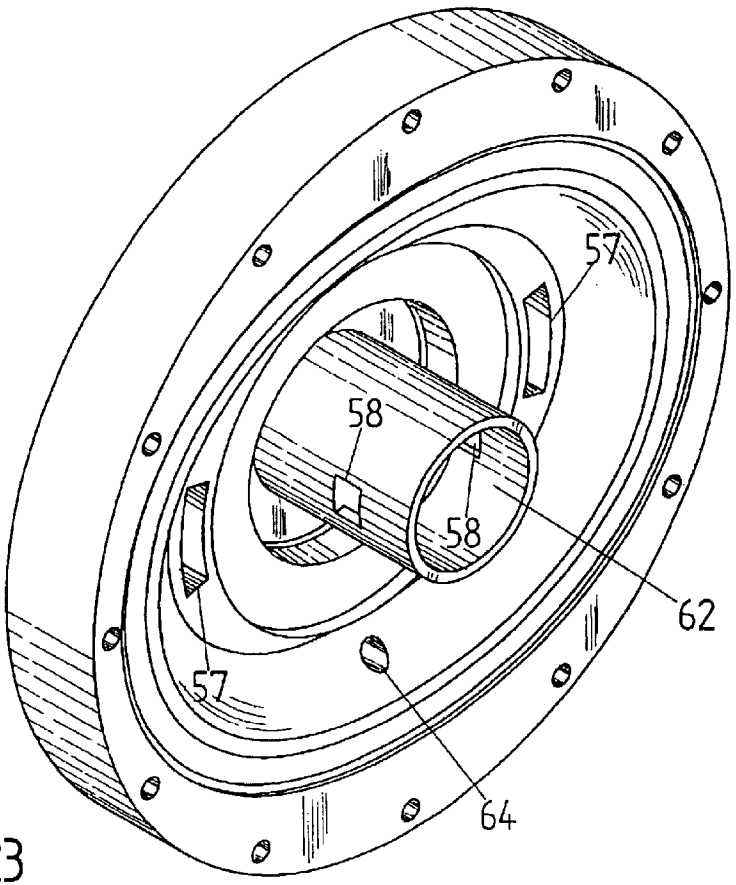
FIG. 23 is an isometric view of a fifth alternate back housing portion of a rotary power device configured to operate as a two-phase internal combustion engine.
Figure 24:
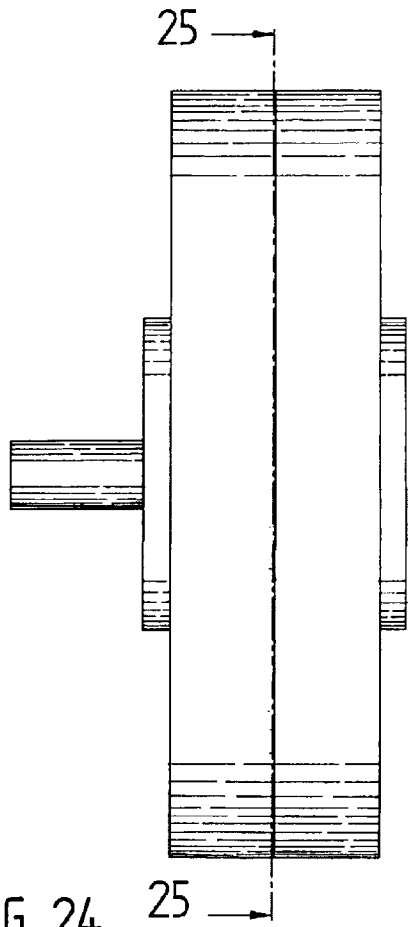
FIG. 24 is a side elevation view of the rotary power device of FIG. 23.
Figure 25:
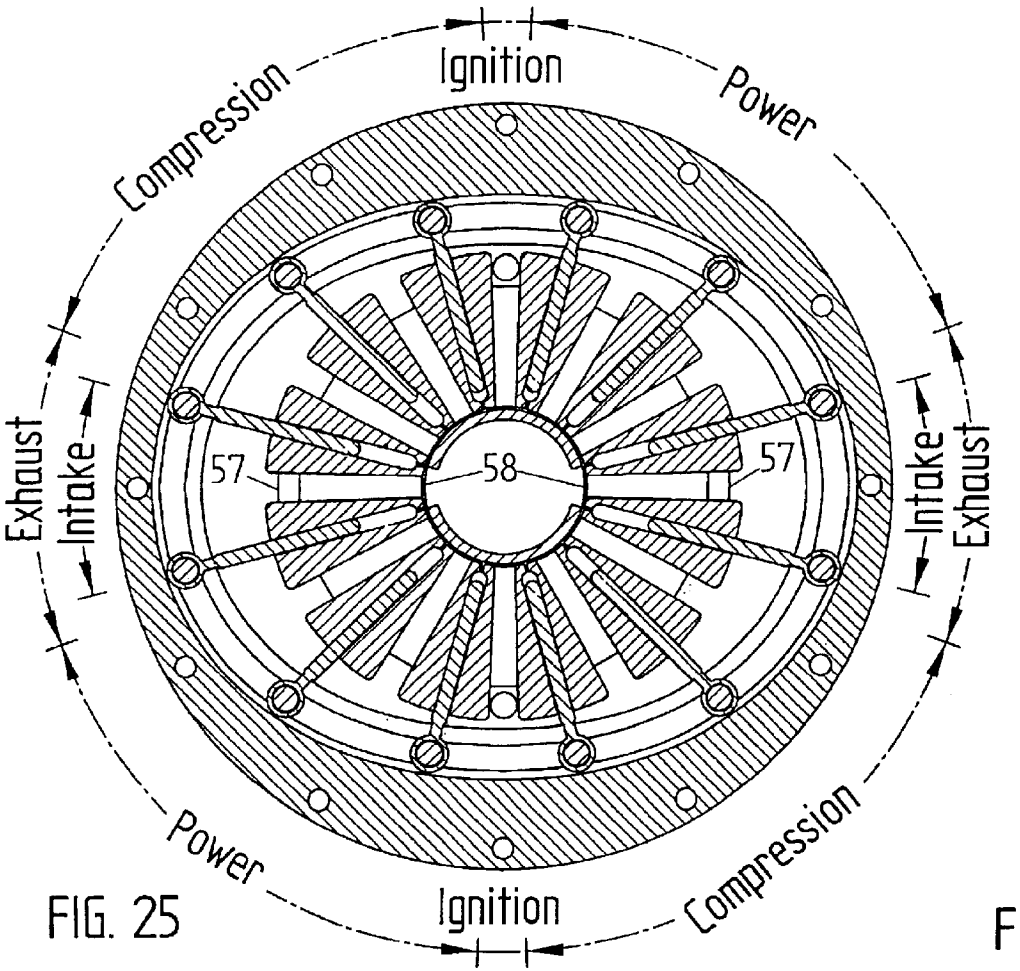
FIG. 25 is a cross-sectional view taken along line 25—25 of FIG. 24.

Another alternative embodiment of the rotary power device of FIG. 1 is one operating as a two-phase internal combustion engine in which the back housing portion 14*b* is replaced with the alternate one shown in FIG. 23. In this embodiment the internal protruding portion 52 of the back portion 14*b* of the split housing only includes an intake channel 62 connected to intake ports 58 axially aligned with rotor compartments openings 46, and the exhaust process takes place in the ports 57 defined in the outer plate portion of the back portion of split housing. In this embodiment the angular extension of the intake ports 58 is less than the angular extent of the exhaust port 56. Also, the intake port 58 is defined over an overlapping angular extension with the exhaust port 57 to allow for air scavenging. A diagonal pair of ignition ports 64 may be used as injection ports adapted to receive injection means (not shown) for the initiation of combustion process. The operation of the device as a two-phase internal combustion engine is shown in FIG. 24 and FIG. 25.

As will be understood by those skilled in the art, various embodiments other than those described in detail in the specification are possible without departing from the scope of the invention will occur to those skilled in the art. It is, therefore, to be understood that the invention is to be limited only by the appended claims.

What is claimed is:

1. A supercharged radial vane rotary power device comprising:

an end shaft extending along a rotation axis;

a rotor assembly rotatable about the rotation axis; and a stator comprising:

a front stator portion having the end shaft journaled therewithin, the front stator portion joined to a back stator portion along respective mating surfaces to form an internal volume containing the rotor assembly;

the back stator portion comprising a central inwardly projecting cylindrical portion comprising at least one channel comprising an intake channel communicating with at least one radial intake port formed in a peripheral wall of the central inwardly projecting portion;

and wherein the rotor assembly comprises:

a rotor block having the end shaft extending therefrom, the end shaft coupled to the rotor block by an axial fan portion comprising a plurality of fan blades extending radially across an intake opening communicating with a central bore for receiving, with rotational clearance, the central inwardly projecting cylindrical portion of the back stator portion; the rotor block rotatably carried by the stator;

radial compartments equidistantly spaced apart about the rotation axis, each of the radial compartments open to an outer peripheral surface of the rotor block, each of the radial compartments having a respective inner opening intermittently communicating with the at least one radial port in the peripheral wall of the central cylindrical inwardly projecting portion of the stator during the course of each rotation of the rotor assembly; and radially extending vane assemblies slidably disposed in respective slots within the rotor block in alternating relation with the radial compartments, each of the vane assemblies comprising a respective cam follower engaging a cam track define by grooves formed in mating surfaces of the front and back stator portions.

2. The supercharged radial vane rotary power device of claim 1 wherein spaces between the fan blades provide fluid communication between the intake opening and the intake channel.

3. The supercharged radial vane rotary power device of claim 1 wherein each of the cam followers comprises a respective freely sliding element capture within a medial ring portion adjacent an outer tip of a respective vane assembly.

4. The supercharged radial vane rotary power device of claim 3 wherein each freely sliding element comprises a respective ball.

5. The supercharged radial vane rotary power device of claim 1 wherein the at least one radial intake port communicates with each of the radial compartments in the course of each rotation of the rotor block;

and the stator portion further comprises:

at least one exhaust channel comprising at least one radial exhaust port formed in a peripheral wall of the central inwardly projecting cylindrical stator portion and communicating with each of the radial compartments in the course of each rotation of the rotor block; and at least one ignition port communicating with each of the radial compartments during each rotation of the rotor block;

whereby the radial vane rotary power device is adapted to function as a four-phase internal combustion engine.

6. The supercharged radial vane rotary power device of claim 1 wherein the at least one radial intake port communicates with each of the radial compartments in the course of each rotation of the rotor block; and the stator portion further comprises:

at least one exhaust channel comprising an exhaust port communicating with each of the radial compartments in the course of each rotation of the rotor block; and at least one ignition port communicating with each of the radial compartments during the course of each rotation of the rotor block;

whereby the radial vane rotary power device is adapted to function as a four-phase internal combustion engine.

7. The supercharged radial vane rotary power device of claim 1, wherein the central inwardly projecting cylindrical stator portion comprises at least two channels comprising the one intake channel connected to a pair of diagonally disposed intake ports, each of the intake ports communicating with each of the radial compartments in the course of each rotation of the rotor block; and one exhaust channel connected to a pair of diagonally disposed exhaust ports, each exhaust port communicating with each of the radial compartments in the course of each rotation of the rotor block;

whereby the radial vane rotary power device is adapted to function as one of a pump, a compressor, a fluid-driven motor and an expander device.

8. The supercharged radial vane rotary power device of claim 1, wherein the intake channel is connected to a pair of diagonally disposed intake ports, each intake port communicating with each of the radial compartments in the course of each rotation of the rotor block; and an outer portion of the comprises at least a diagonally disposed pair of exhausts channels connected to at least one exhaust port, each exhaust channel communicating with each of the radial compartments in the course of each rotation of the rotor block;

whereby the radial vane rotary power device is adapted to function as one of a pump, a compressor, a fluid-driven motor and an expander device.

9. The supercharged radial vane rotary power device of claim 1 wherein the central inwardly projecting cylindrical portion comprises at least two channels comprising:

the intake channel, which is connected to a pair of diagonally disposed intake ports, each intake port communicating with each of the radial compartments in the course of each rotation of the rotor block; and an exhaust channel, which is connected to a pair of diagonally disposed exhaust ports, each exhaust port communicating with each of the radial compartments in the course or each rotation of the rotor block; and wherein an outer portion of the back stator portion comprises at least a pair of diagonally disposed ignition ports for receiving respective igniters, each of the ignition ports communicating with each of the radial compartments during each rotation of the rotor block;

whereby the radial vane rotary power device is adapted to function as two-phase internal combustion engine.

10. The supercharged radial vane rotary power device of claim 1 wherein the intake channel is connected to a pair of diagonally disposed intake ports, each intake port communicating with each of the radial compartments in the course of each rotation of the rotor block;

an outer portion of the back stator portion comprises a pair of diagonally disposed exhaust channels connected to at least one exhaust port, each exhaust channel communicating with each of the radial compartments in the course of each rotation of the block; and the outer portion of the back stator portion comprises at least a pair of diagonally disposed ignition ports, each ignition port communicating with each of the radial compartments during each rotation of the rotor block;

whereby the radial vane rotary power device is adapted to function as two-phase internal combustion engine.

11. The supercharged radial vane rotary power device of claim 1 wherein the central inwardly projecting cylindrical stator portion comprises a transverse wall separating a frontal intake channel from a back exhaust channel.

12. A supercharged four-phase rotary internal combustion engine comprising:

a stator defining an internal volume having an oval cross-section transverse to an axis of rotation and comprising front and back stator portions having mating surfaces for mating along a medial plane transverse to the axis of rotation:

the front and back stator portions comprising cam grooves in the mating surfaces to define a cam track encircling the internal volume and to communicate with the internal volume through an encircling slot formed from recessed wall portions of the mating surfaces of the back and front stator portions;

the front stator portion comprising a central throughhole for receiving an end shaft extending along the axis from a rotor block, the back stator portion comprising a central inwardly projecting cylindrical portion projecting into the internal volume along the axis of rotation, the central inwardly projecting cylindrical portion comprising at least one intake channel for communicating with at least one peripheral intake port;

a rotor assembly comprising the rotor block comprising a central cylindrical bore for receiving the central inwardly projecting cylindrical stator portion, the rotor block coupled to an end shaft by an axial fan portion for inducting a charge and for communicating the charge to the at least one intake channel of the central inwardly projecting portion of the back stator portion, the rotor block rotatable within a rotor chamber portion of the internal volume lying between the central inwardly projecting cylindrical stator portion and an inner peripheral wall of the internal volume, the rotor block comprising radial compartments equidistantly spaced apart about the rotation axis of the device, each of the radial compartments open to a peripheral surface of the block and having a respective inner opening communicating with the at least one axially aligned radial port in the central inwardly projecting cylindrical stator portion during the course of each rotation of the rotor assembly, the rotor assembly further comprising radially extending vane slots disposed within the rotor block in alternating relation with the radial compartments; and vane assemblies, each vane assembly comprising a respective inner flat portion slidably received in a respective rotor slot and a respective cam follower captured within the cam track.

13. The supercharged four-phase rotary internal combustion engine of claim 12 wherein the central inwardly projecting cylindrical stator portion further comprises an exhaust channel communicating with a peripheral exhaust port; and wherein an outer external stator portion comprises an ignition port.

14. The supercharged four-phase rotary internal combustion engine of claim 12 wherein an outer external stator portion comprises an igniter and an exhaust channel connected to an exhaust port.

15. The supercharged four-phase rotary internal combustion engine of claim 12 wherein the axial fan portion comprises a plurality of blades, each of the blades having a respective base coupled to the end shaft, each of the blades further having a respective outer tip fixed to the rotor block.

16. A rotary power device operable as one of a pump and an expander, the device comprising:

a stator having an internal volume having an oval cross-section transverse to an axis of rotation and comprising front and back stator portions mating along a medial transverse plane perpendicular to the axis of rotation; the front stator portion comprising a central throughhole, the back stator portion comprising a central inwardly projecting cylindrical portion extending into the internal volume along the axis of rotation, the central inwardly projecting cylindrical portion comprising at least one intake channel communicating with at least one pair of diagonally opposed peripheral intake ports, the intake channel for receiving an intake fluid charge passing between blades of an axial fan portion of a rotor block;

a rotor assembly comprising:

an end shaft rotatable about the axis of rotation and extending outwardly from the throughhole in the front stator portion, the end shaft connected to the rotor block by the axial fan portion;

the rotor block comprising a central cylindrical bore for receiving the central inwardly projecting cylindrical stator portion, the rotor block rotatable within a rotor chamber portion of the internal volume lying between the central inwardly projecting cylindrical stator portion and an inner peripheral wall of the internal volume;

radial compartments equidistantly spaced apart about the axis of rotation, each of the radial compartments open to a peripheral surface of the block, each of the radial compartments having a respective inner opening communicating with the at least one port in the peripheral wall of the central inwardly projecting cylindrical stator portion at least once during the course of each rotation of the rotor assembly;

radially extending vane slots disposed within the rotor block in an alternating relation with the radial compartments; and vane assembles, comprising respective inner flat portions slidably received in respective vane slots and respective cam followers slidably received in a cam track formed in the stator.

17. The rotary power device of claim 16 wherein the stator further comprises two diametrically opposed exhaust channels, each of the exhaust channels comprising a respective recessed wall portion in an inner wall of the stator, each of the exhaust channels connected to a respective exhaust port spaced radially outwardly from the central inwardly projecting cylindrical stator portion.

18. The rotary power device of claim 16 wherein the central inwardly projecting cylindrical stator portion comprises two diametrically opposed exhaust ports communicating with a common exhaust channel.

19. The rotary power device of claim 16 wherein each of the blades of the axial fan portion comprises a respective base coupled to the end shaft and a respective outer tip fixed to a hub portion of the rotor block.

20. A supercharged two-phase internal combustion engine comprising a stator defining an internal volume having an oval cross-section transverse to an axis of rotation, the stator comprising respective front and back stator portions comprising respective mating surfaces for mating along a medial plane transverse to the axis of rotation, the front and back stator portions comprising respective cam grooves in mating surfaces to define a cam track encircling the internal volume and communicating with the internal volume through an encircling slot formed from recessed wall portions of the respective mating surfaces of the back and front stator portions; the front stator portion comprising a central throughhole for rotatably carrying an end shaft; the back stator portion comprising a central inwardly projecting cylindrical portion projecting into the internal volume along the axis of rotation, the central inwardly projecting cylindrical portion comprising at least one intake channel having at least one pair of diagonally disposed peripheral intake ports;

a rotor assembly comprising a rotor block comprising a central cylindrical bore for receiving the central inwardly projecting cylindrical stator portion, the rotor block coupled to the end shaft by an axial fan portion for inducting a charge into the at least one intake channel in the central inwardly projecting cylindrical stator portion of the back stator portion the rotor block rotatable within a rotor chamber portion of the internal volume lying between the central inwardly projecting cylindrical stator portion and an inner peripheral wall of the internal volume, the rotor block comprising radial compartments equidistantly spaced apart about the axis of the device, each of the rotor compartments open to a peripheral surface of the block, each of the rotor compartments having a respective inner opening communicating with the at least one axially aligned radial port in the central inwardly projecting cylindrical stator portion during the course of each rotation of the rotor assembly, the rotor assembly further comprising radially extending vane slots disposed within the rotor block in alternating relation with the radial compartments; and vane assembles comprising respective inner flat portions slidably received in respective rotor slots and respective cam followers adjacent respective outer tips of associated inner flat portions, the cam followers captured within the cam track.

21. The supercharged two-phase rotary internal combustion engine of claim 20 wherein the central inwardly projecting cylindrical stator portion further comprises an exhaust channel communicating with a pair of diagonally disposed peripheral exhaust ports.

22. The supercharged two-phase rotary internal combustion engine of claim 20 wherein the central inwardly projecting cylindrical stator portion comprises an intake channel communicating with a pair of diagonally disposed peripheral intake port and the outer stator portion comprises both a pair of exhaust channels connected to respective exhaust ports and a pair of diagonally disposed ignition ports.

23. The supercharged two-phase rotary internal combustion engine of claim 20 wherein the axial fan portion comprises a plurality of blades, each blade having a respective base fixed to the end shaft and a respective outer tip fixed to the rotor block.

* * * * *